US012616867B2

(12) United States Patent
Cheng et al.

(10) Patent No.: US 12,616,867 B2
(45) Date of Patent: May 5, 2026

(54) DUMBBELL AND DUMBBELL ASSEMBLY

(71) Applicants: Zhengxiang Cheng, Huanggang (CN); Jun Jiang, Huanggang (CN)

(72) Inventors: Zhengxiang Cheng, Huanggang (CN); Jun Jiang, Huanggang (CN)

( * ) Notice: Subject to any disclaimer, the term of this patent is extended or adjusted under 35 U.S.C. 154(b) by 157 days.

(21) Appl. No.: 18/510,586

(22) Filed: Nov. 15, 2023

(65) Prior Publication Data

US 2025/0135260 A1 May 1, 2025

(30) Foreign Application Priority Data

Oct. 27, 2023 (CN) ..... 202322922034.3

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/072–075
See application file for complete search history.

(56) References Cited

U.S. PATENT DOCUMENTS 7,261,678 B2 * 8/2007 Crawford ..... A63B 71/0054 482/94
9,504,868 B2 11/2016 Liu
9,616,273 B2 4/2017 Chen
9,776,032 B2 * 10/2017 Moran ..... A63B 24/0087
9,889,331 B2 2/2018 Svenberg
9,895,571 B2 2/2018 Wang
10,195,477 B2 * 2/2019 Marjama ..... A63B 21/0728
10,518,123 B2 * 12/2019 Moran ..... A63B 21/075
11,478,675 B2 * 10/2022 Chen ..... A63B 21/0728
11,504,567 B1 * 11/2022 Hong ..... A63B 21/072
11,642,563 B2 * 5/2023 Weng ..... A63B 21/075 482/107
RE49,624 E 8/2023 Nalley
11,883,707 B2 * 1/2024 Hong ..... A63B 21/0726
2009/0042700 A1 * 2/2009 Liu ..... A63B 21/0728 482/107
2013/0244843 A1 * 9/2013 Burwell ..... A63B 21/0728 29/428
2022/0088432 A1 * 3/2022 Wang ..... A63B 21/0724
2022/0193481 A1 * 6/2022 Wu ..... A63B 21/0728
2023/0271050 A1 * 8/2023 Tong ..... A63B 21/0728 482/108
2024/0252873 A1 * 8/2024 Pohl ..... A63B 21/0728
2025/0010121 A1 * 1/2025 Jiang ..... A63B 21/075
2025/0058164 A1 * 2/2025 Zhang ..... A63B 21/075
2025/0090889 A1 * 3/2025 Hong ..... A63B 21/0726

* cited by examiner

*Primary Examiner* — Megan Anderson
*Assistant Examiner* — Kathleen M Fisk

(57) ABSTRACT

Provided herein is a dumbbell, including a dumbbell rod assembly and dumbbell plates, where the dumbbell rod assembly includes a dumbbell rod, each of the dumbbell plates is provided with a second clamping portion, the middle of the dumbbell rod is sleeved with a handle, two sides of the dumbbell rod are provided with hanging assemblies respectively, each of the hanging assemblies includes a plurality of lock discs, each of the lock discs is provided with a first clamping portion and a stand column, and the second clamping portion of the dumbbell plate moves relatively between the stand column and the first clamping portion of the lock disc and is clamped with the first clamping portion.

8 Claims, 17 Drawing Sheets

DUMBBELL AND DUMBBELL ASSEMBLY

TECHNICAL FIELD

The present disclosure relates to the technical field of fitness equipment, in particular to a dumbbell and a dumbbell assembly.

BACKGROUND

Dumbbells are relatively popular equipment in fitness equipment and include integrated dumbbells and assembled dumbbells, and the assembled dumbbells are small in size, adjustable in weight and more suitable for home daily muscle strength exercises. At present, the traditional assembled dumbbells each include a dumbbell rod and dumbbell plates, and the number of the dumbbell plates on the dumbbell rod is adjusted to adjust the weight of the dumbbell so as to change the training intensity. However, for the common dumbbell, during replacement of the dumbbell plates, fixing members at two ends need to be removed before taking down the dumbbell plates, and the replacement process is very troublesome; in addition, in case of misoperation, the dumbbell plates may hurt feet or damage the ground.

SUMMARY

The present disclosure aims to provide a dumbbell and a dumbbell assembly, and overcomes the defects in the prior art.

In order to achieve the above purpose, the present disclosure provides the following technical solution:

the first aspect of the present application provides the dumbbell, comprising a dumbbell rod assembly and a plurality of dumbbell plates, where the dumbbell rod assembly comprises a dumbbell rod; the top of each of the dumbbell plates is provided with a radially formed U-shaped insertion port, and a first surface of the dumbbell plate is provided with a second clamping portion protruding outwards and having the same radial direction as the insertion port;

the middle of the dumbbell rod is sleeved with a handle capable of rotating circumferentially around the dumbbell rod;

two sides of the dumbbell rod are provided with hanging assemblies respectively;

each of the hanging assemblies comprises a plurality of lock discs, and the plurality of lock discs are rotatably sleeved on the dumbbell rod in sequence and rotate synchronously with the handle;

a first surface of each of the lock discs is provided with at least one first clamping portion provided in a circumferential direction of an outer edge of the first surface and at least one clamping inlet allowing the second clamping portion of the respective dumbbell plate to pass through, the center of the lock disc is provided with a stand column extending outwards along the first surface of the lock disc, and the center of the stand column is provided with a first through hole allowing the dumbbell rod to pass through;

the stand column of each of the lock discs is in clearance fit with the insertion port of the respective dumbbell plate, and is capable of reciprocating and circumferentially rotating in the insertion port in an open direction of the insertion port; and when each of the stand columns moves to the bottom of the respective insertion port, the respective lock disc is rotated, and the second clamping portion of the respective dumbbell plate is capable of moving relatively between the stand column and the first clamping portion of the lock disc and being clamped with the first clamping portion.

The second aspect of the present application provides the dumbbell assembly, comprising the dumbbell and a tray for placing the dumbbell, where the top of the tray is provided with a plurality of parallel insertion plates, and the dumbbell plates are capable of being vertically placed between every two adjacent insertion plates; the top of the tray is provided with lock columns, and when the dumbbell is placed at the top of the tray, the lock columns are capable of extending into first sliding grooves and driving stoppers to move inwards, enabling locking mechanisms to be in an unlocked state; and when the dumbbell is taken out of the tray, the lock columns are separated from the first sliding grooves, the stoppers move outwards under the action of the elasticity of first springs, lock blocks of the stoppers enter lock grooves, and the locking mechanisms are switched to a locked state.

Compared with the prior art, the present disclosure has the advantages that in the present application, the dumbbell plates are hung on the hanging assemblies through interlocking of the lock discs and the dumbbell plates, the dumbbell plates are provided with the second clamping portions, the second clamping portions are provided with clamping grooves, the lock discs are provided with the first clamping portions, and the arc-shaped bottoms of the first clamping portions are capable of extending into the clamping grooves, thereby further limiting the dumbbell plates, that is, the bottoms of the U-shaped insertion ports of the dumbbell plates and end portions of the second clamping portions are limited between the stand columns and the first clamping portions of the lock discs, and the dumbbell plates cannot move in the radial directions of the lock discs; in addition, the second clamping portions of the dumbbell plates are limited between the first clamping portions of the lock discs and the first surfaces of the lock discs, such that the dumbbell plates cannot move in the circumferential directions of the lock discs, and the dumbbell plates are hung on the hanging assemblies more safely by means of said limitations. Besides, the present application provides the locking mechanisms, which can prevent the handle from rotating at will without limitations, and can prevent falling of the dumbbell plates due to unintentional rotation of the handle. Thirdly, the locking mechanisms are further optimized in the present application, and guide structures are increased, thereby preventing the situation that lock catches of the stoppers of the locking mechanisms stay between the two lock grooves and cannot be in the locked state.

BRIEF DESCRIPTION OF THE DRAWINGS

Drawings constituting a portion of the present application are used for providing a further understanding to the present disclosure. Schematic embodiments of the present disclosure and descriptions thereof are intended to explain the present disclosure, and should not be construed to unduly limit the present disclosure. In the drawings.

Figure 1:
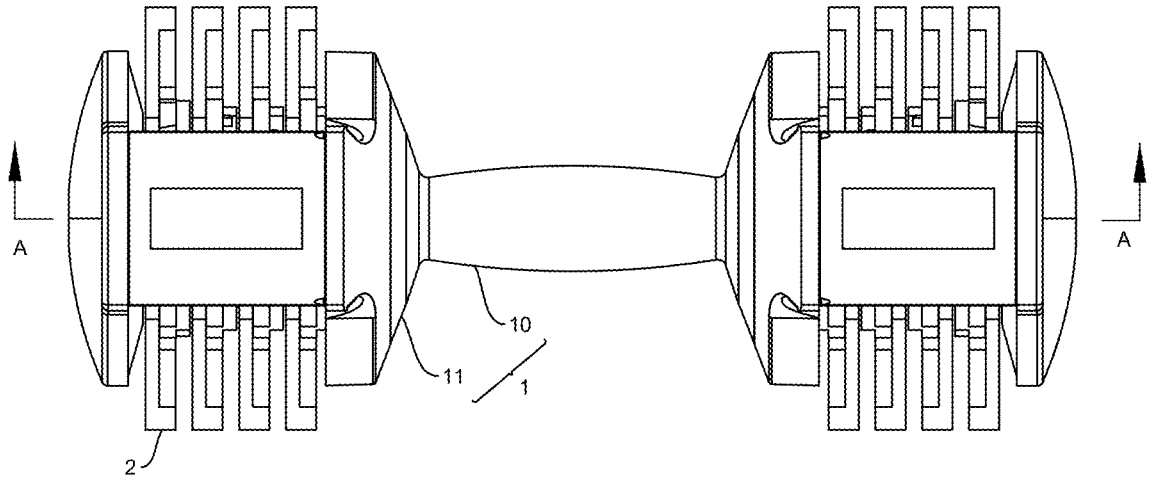
FIG. 1 is an overall structure diagram of a dumbbell in an embodiment of the present disclosure.

Description of reference numerals: 1—dumbbell rod assembly; 10—handle; 101—dumbbell rod; 1011—clamping protrusion; 11—hanging assembly; 11*a*—left hanging assembly; 11*b*—right hanging assembly; 12—first baffle; 1201—second through hole; 1202—dividing disc; 12021—graduated ring; 12022—lock groove; 12023—guide groove; 12024—third through hole; 12025—graduated disc; 12026—open groove; 1203—stopper; 12031—lock block; 12032—pressing portion; 1204—first sliding groove; 1205—first spring; 1206—guide member; 1207—second sliding groove; 1208—second spring; 1209—mark point; 13—second baffle; 14—connecting plate; 15—lock disc; 15*a*—first lock disc; 15*b*—second lock disc; 15*c*—third lock disc; 15*d*—fourth lock disc; 1501—first clamping portion; 1502—clamping inlet; 1503—first through hole; 1504—stand column; 1505—inner arc surface; 1505*a*—arc-shaped top edge; 1505*b*—arc-shaped bottom edge; 1506—protruding portion; 1507—polygonal column; 1508—polygonal groove; 2—dumbbell plate; 2*a*—first dumbbell plate; 2*b*—second dumbbell plate; 2*c*—third dumbbell plate; 2*d*—fourth dumbbell plate; 201—insertion port; 202—weight stack; 2021—accommodating groove; 203—second clamping portion; 2031—clamping groove; 3—base; 301—insertion plate; and 302—lock column.

DETAILED DESCRIPTION OF THE EMBODIMENTS

The present disclosure is described in detail below with reference to the accompanying drawings and in conjunction with embodiments. Each example is provided to explain the present disclosure instead of limiting the present disclosure. In fact, those skilled in the art will know that modifications and variations may be made in the present disclosure without departing from the scope or spirit of the present disclosure. For example, features shown or described as part of one embodiment may be used in another embodiment to produce yet another embodiment. Therefore, it is expected that the present disclosure includes such modifications and variations that fall within the scope of the appended claims and equivalents thereof.

In the descriptions of the present disclosure, orientations or positional relationships indicated by the terms "longitudinal", "transverse", "upper", "lower", "front", "rear", "left", "right", "vertical", "horizontal", "top", "bottom" and the like are orientations or positional relationships based on the drawings, are only for the purpose of facilitating describing of the present disclosure, and do not indicate that the present disclosure must be constructed and operated in the specific orientations. Therefore, they cannot be understood as limitations on the present disclosure. The terms "connection", "connecting" and "arrangement" used in the present disclosure should be understood in a broad sense, for example, the connection may be fixed connection, and may also be detachable connection; the connection may be direct connection, and may also be indirect connection by means of intermediate components; the connection may be wired electrical connection and wireless electrical connection, and may also be wireless communication signal connection; and for those of ordinary skill in the art, the specific meanings of the above-mentioned terms can be understood according to the specific situations.

The accompanying drawings show one or more examples of the present disclosure. Numeral and letter mark points 1209 are used in the detailed descriptions to refer to the features in the accompanying drawings. Similar or like mark points 1209 in the accompanying drawings and the descriptions have been used to refer to similar or like parts of the present disclosure. As used herein, the terms "first", "second", "third" and the like are used interchangeably so as to distinguish one component from another, and are not intended to indicate the positions or the importance of the individual components.

Figure 3:
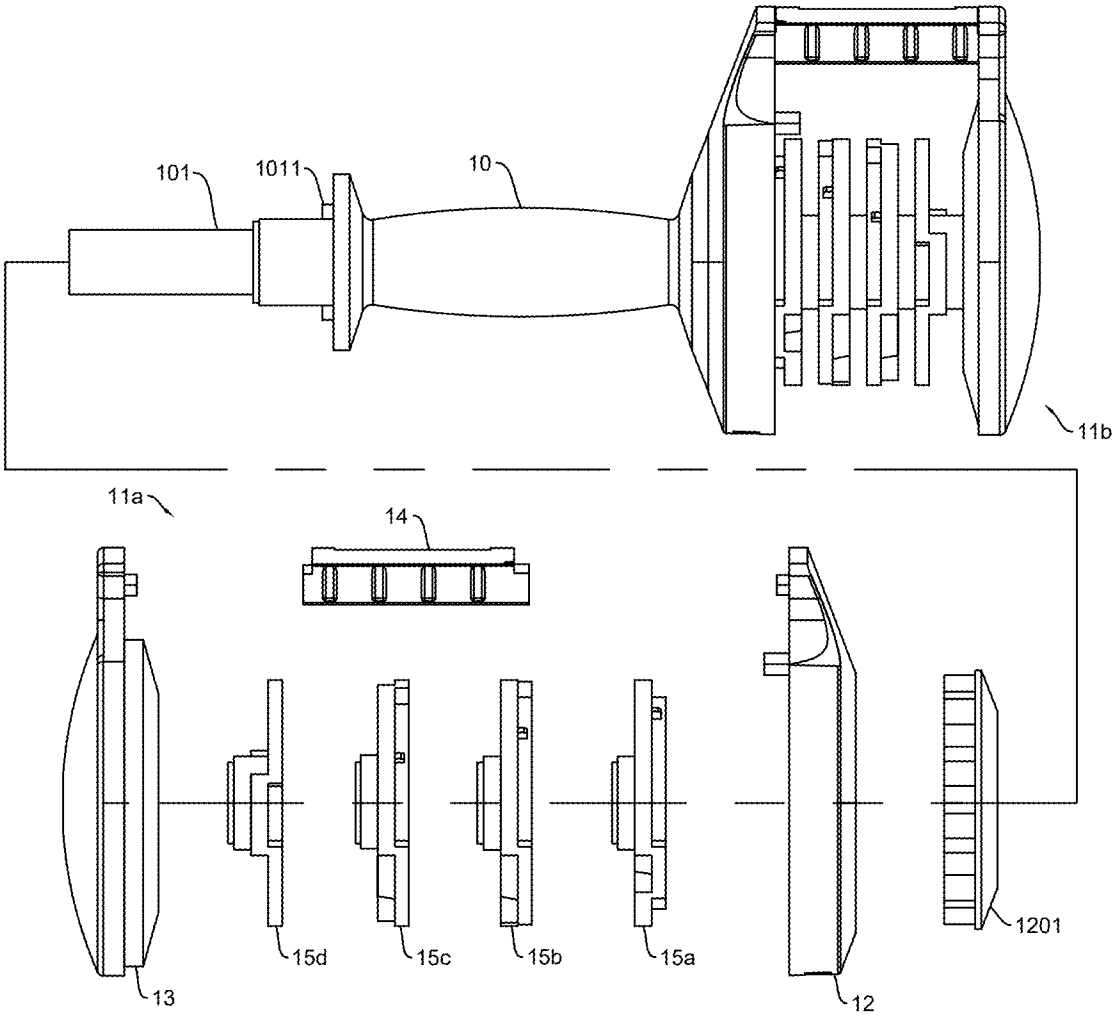
FIG. 3 is a structure diagram of a dumbbell rod assembly and an exploded view of a hanging assembly in an embodiment of the present disclosure.

As shown in FIGS. 1 and 3, according to an embodiment of the present disclosure, a dumbbell is provided and includes a dumbbell rod assembly 1 and a plurality of dumbbell plates 2. The dumbbell rod assembly 1 includes a dumbbell rod 101 and two hanging assemblies 11, the middle of the dumbbell rod 101 is sleeved with a rotatable handle 10, the two hanging assemblies 11 are rotatably sleeved on two ends of the dumbbell rod 101 respectively, and the dumbbell plates 2 are connected to the hanging assemblies 11 in an interlocked manner.

Figure 4:
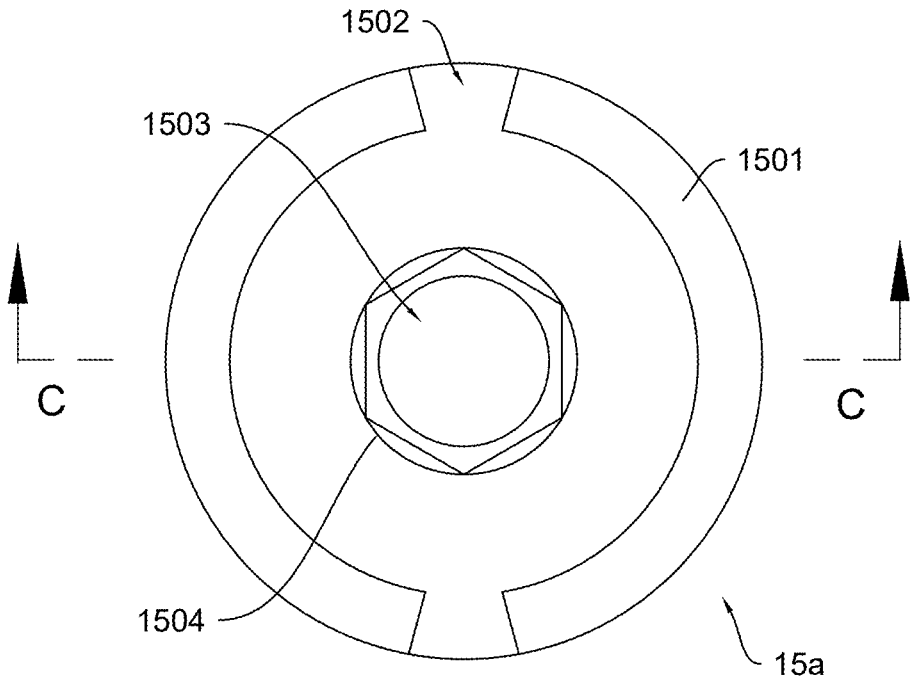
FIG. 4 is a structure diagram of a first lock disc in an embodiment of the present disclosure.
Figure 5:
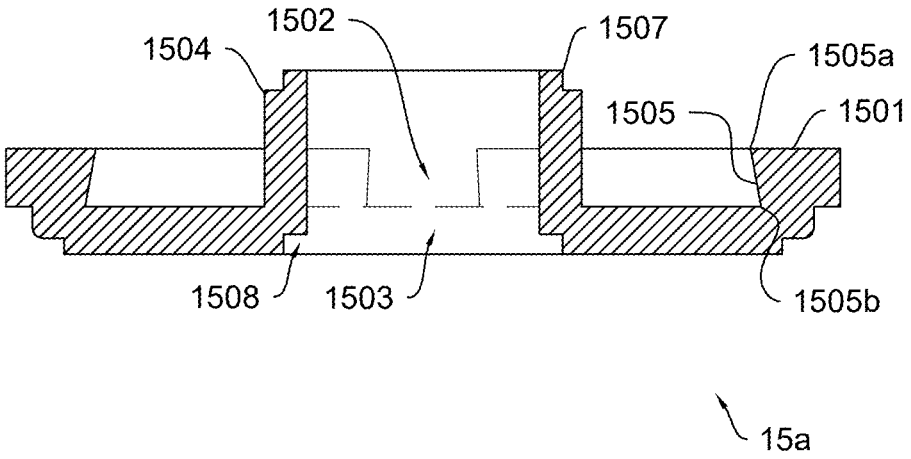
FIG. 5 is a section view of FIG. 4 in the CC direction.

Each of the hanging assemblies 11 includes a plurality of lock discs 15, the plurality of lock discs 15 are of similar structures, and the similarities between the lock discs 15 lie in that, taking a first lock disc 15*a* as an example, as shown in FIGS. 4-5, the first lock disc 15*a* includes a first surface and a second surface facing away from the first surface. The center of the first lock disc 15*a* is provided with a first through hole 1503 and a stand column 1504 extending outwards along the first surface, the first through hole 1503 penetrates through the stand column 1504, and the height of the stand column 1504 is adapted to the thickness of each dumbbell plate 2 and the distance between two adjacent dumbbell plates 2. The first lock disc 15*a* is provided with two first clamping portions 1501 uniformly distributed in a circumferential direction of an outer edge of the first surface, and the first clamping portions 1501 have arc-shaped sections. An opening between the two first clamping portions 1501 is a clamping inlet 1502.

The differences between the plurality of lock discs 15 lie in that, as shown in FIGS. 4, 6, 7 and 8, the radian of the first clamping portions 1501 of the first lock disc 15*a*, a second lock disc 15*b*, a third lock disc 15*c* and a fourth lock disc 15*d* is gradually reduced in sequence, and on the contrary, the clamping inlets 1502 of the plurality of lock discs 15 are gradually enlarged in sequence.

The plurality of lock discs 15 are sleeved on an outer side of the dumbbell rod 101 in a clearance fit manner by means of the first through holes 1503, and the plurality of lock discs 15 rotate synchronously with the handle 10.

Figure 9:
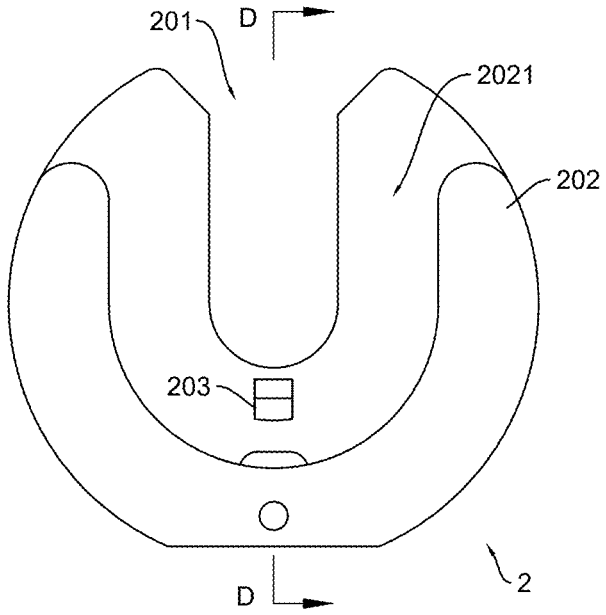
FIG. 9 is a structure diagram of a dumbbell plate in an embodiment of the present disclosure.
Figure 10:
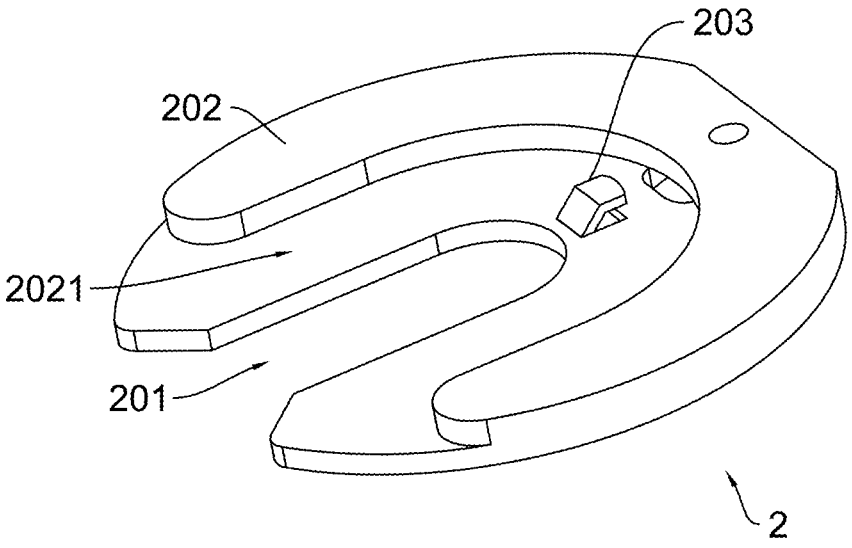
FIG. 10 is a stereogram of a dumbbell plate in an embodiment of the present disclosure.
Figure 11:
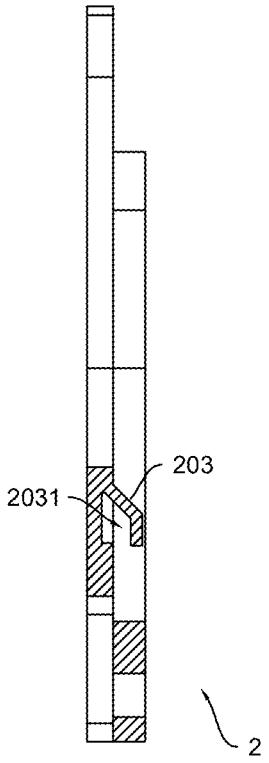
FIG. 11 is a section view of FIG. 9 in the DD direction.

As shown in FIGS. 9-11, each of the dumbbell plates 2 includes a first surface and a second surface facing away from the first surface. The top of the dumbbell plate 2 is provided with a radially formed U-shaped insertion port 201, and the stand column 1504 of the respective lock disc 15 is in clearance fit with the insertion port 201 and can move inside the insertion port 201 in an extension direction of the insertion port 201 and rotate circumferentially. The first surface of the dumbbell plate 2 is provided with a second clamping portion 203 protruding outwards and having the same radial direction as the insertion port 201, and the end of the second clamping portion 203 facing away from the insertion port 201 is provided with a clamping groove 2031 formed in a circumferential direction of the dumbbell plate 2.

In some embodiments, one surface of each of the dumbbell plates 2 is provided with a weight stack 202, and the weight stack 202 is provided with a U-shaped accommodating groove 2021 having the same open direction as the respective insertion port 201. The accommodating groove 2021 can receive any lock disc 15, and any lock disc 15 can move and circumferentially rotate in the accommodating groove 2021.

Figure 2:
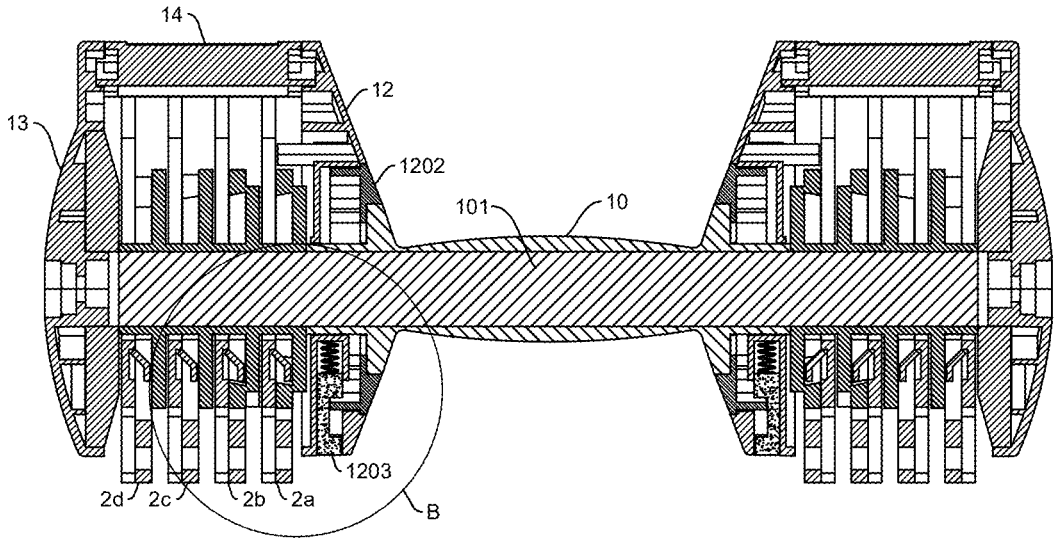
FIG. 2 is a section view of FIG. 1 in the AA direction.
Figure 12:
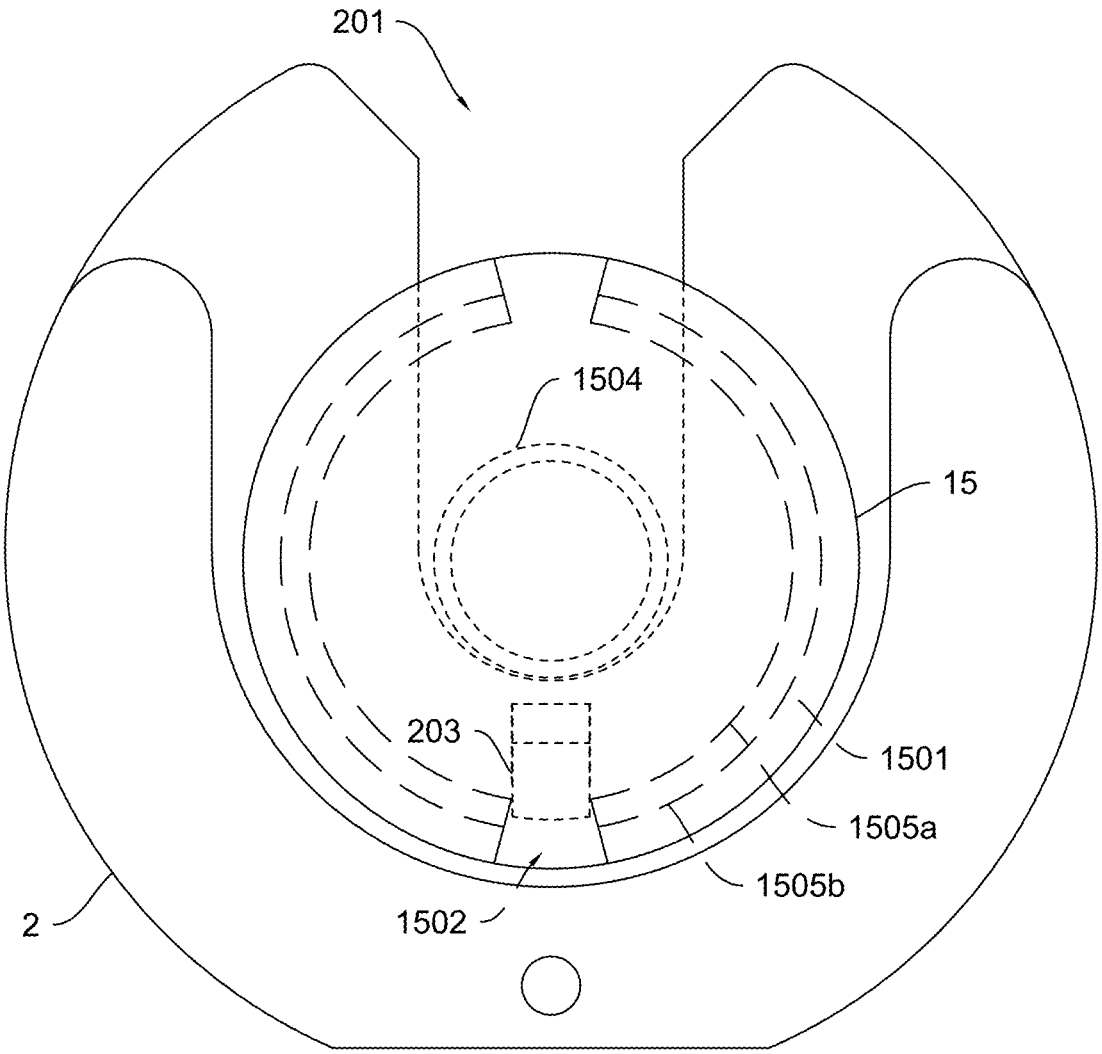
FIG. 12 is a schematic diagram of a dumbbell plate inserted into a lock disc in an embodiment of the present disclosure.

As shown in FIGS. 2 and 12, when the dumbbell rod assembly 1 and the dumbbell plates 2 are assembled, the first surfaces of the dumbbell plates 2 are closely attached to the first surfaces of the corresponding lock discs 15 to be inserted. The second clamping portions 203 of the dumbbell plates 2 will pass through the clamping inlets of the lock discs 15, and finally stay between the stand columns 1504 and the first clamping portions 1501 of the lock discs 15.

Figure 13:
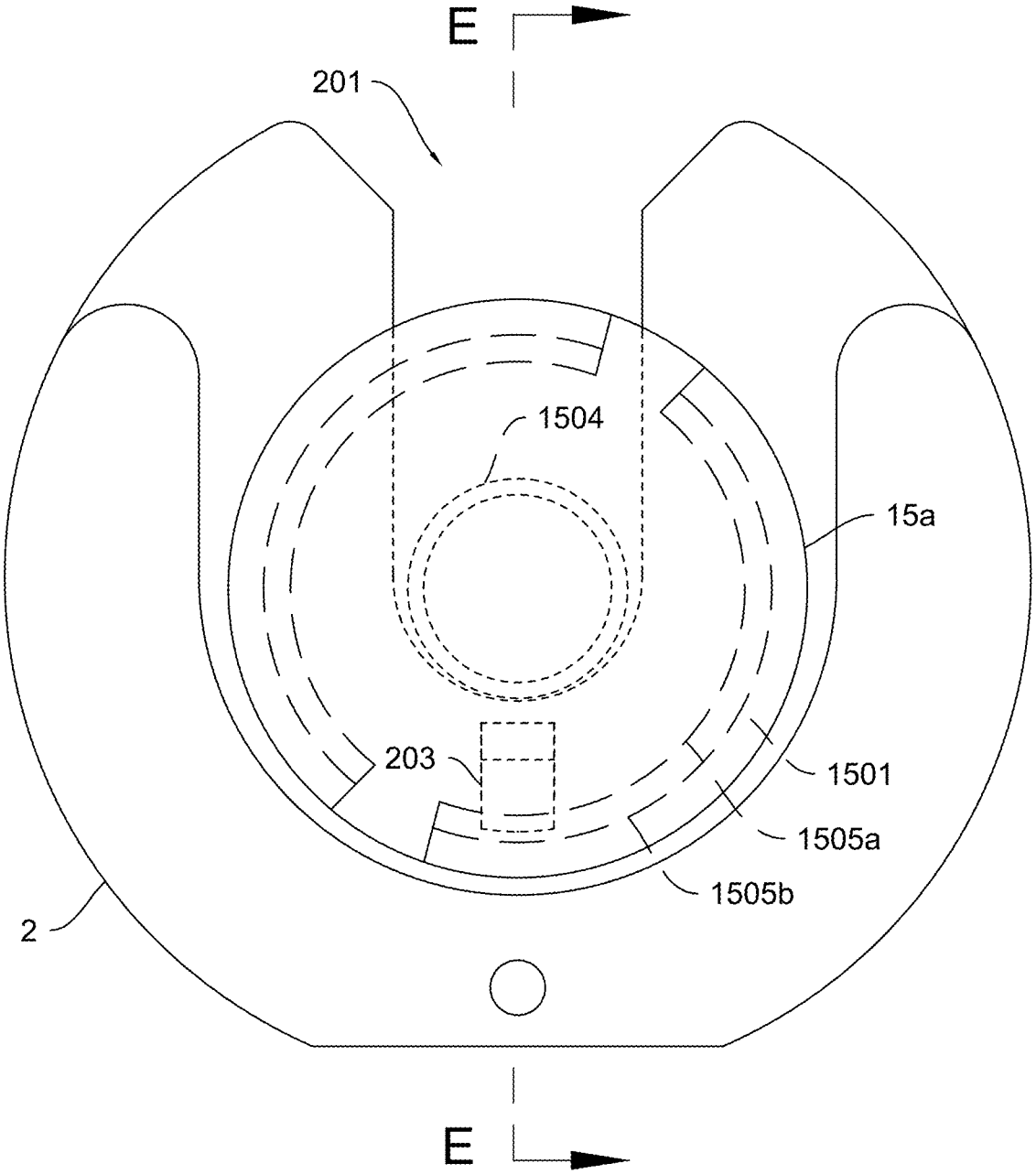
FIG. 13 is a schematic diagram for interlocking of a dumbbell plate and a lock disc in an embodiment of the present disclosure.
Figure 14:
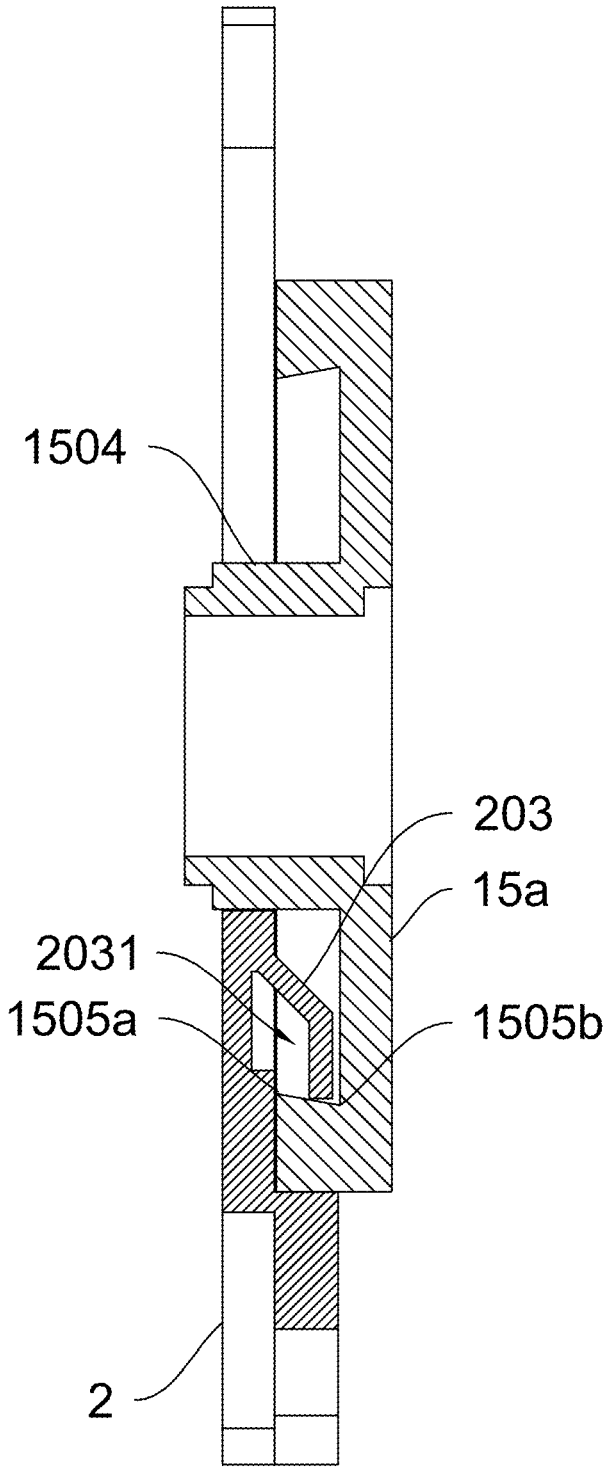
FIG. 14 is a section view of FIG. 13 in the EE direction.

As shown in FIGS. 13 and 14, when the weight is adjusted, the handle 10 is rotated, the lock discs 15 rotate synchronously with the handle 10, and the first clamping portions 1501 of the lock discs 15 are snap-fitted with the second clamping portions 203 of the dumbbell plates 2. Then the bottoms of the insertion ports 201 of the dumbbell plates 2 are limited by the stand columns 1504 of the lock discs 15, the second clamping portions of the dumbbell plates 2 are limited by the first clamping portions 1501 of the lock discs 15, and the dumbbell plates 2 are interlocked with the lock discs 15.

Specifically, for Embodiment 1 of the first clamping portion 1501, as shown in FIGS. 5, 13 and 14, the radius of an arc-shaped bottom edge 1505*b* of an inner arc surface 1505 of the first clamping portion 1501 is greater than that of an arc-shaped top edge 1505*a*, and thus the inner arc surface 1505 has an inclination with the inward bottom. In this embodiment, the lock disc 15 rotates synchronously with the handle 10, the arc-shaped top edge 1505*a* of the first clamping portion 1501 of the lock disc 15 will extend into the clamping groove 2031 of the second clamping portion 203 of the respective dumbbell plate 2, an end portion of the second clamping portion 203 will abut against the inner arc surface 1505 of the first clamping portion 1501, and the dumbbell plate 2 is locked under the limitations of the stand column 1504 and the first clamping portion 1501 of the lock disc 15. The limitations include the limitations on the dumbbell plate 2 in radial and axial directions of the lock disc 15.

Figure 15:
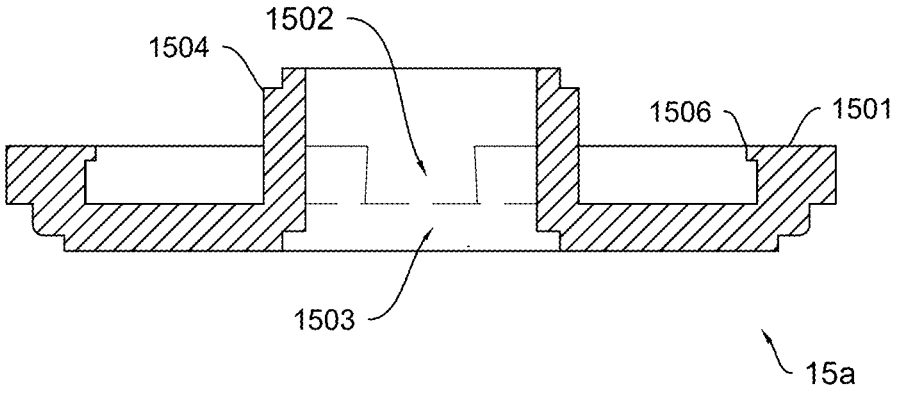
FIG. 15 is a structure diagram of Embodiment 2 of a first clamping portion in an embodiment of the present disclosure.

For Embodiment 2 of the first clamping portion 1501, as shown in FIG. 15, the top of the first clamping portion 1501 is provided with a protruding portion 1506 extending inwards in the radial direction of the respective lock disc 15. In combination with Embodiment 1 of the first clamping portion 1501, in this embodiment, the lock disc 15 rotates synchronously with the handle 10, the protruding portion 1506 of the first clamping portion 1501 of the lock disc 15 will extend into the clamping groove 2031 of the second clamping portion 203 of the respective dumbbell plate 2, and the dumbbell plate 2 is locked under the limitations of the stand column 1504 and the first clamping portion 1501 of the lock disc 15. The limitations also include the limitations on the dumbbell plate 2 in radial and axial directions of the lock disc 15.

Figure 6:
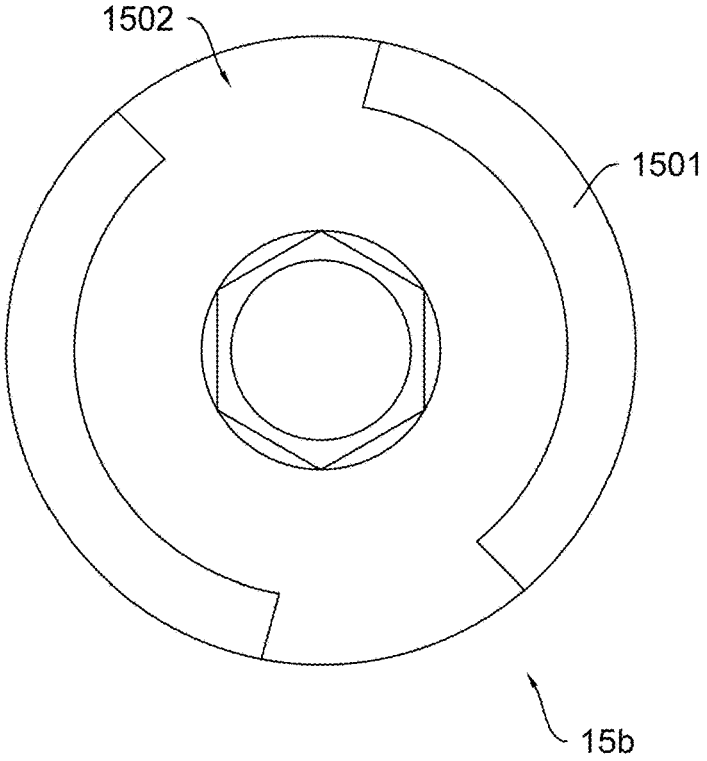
FIG. 6 is a structure diagram of a second lock disc in an embodiment of the present disclosure.
Figure 7:
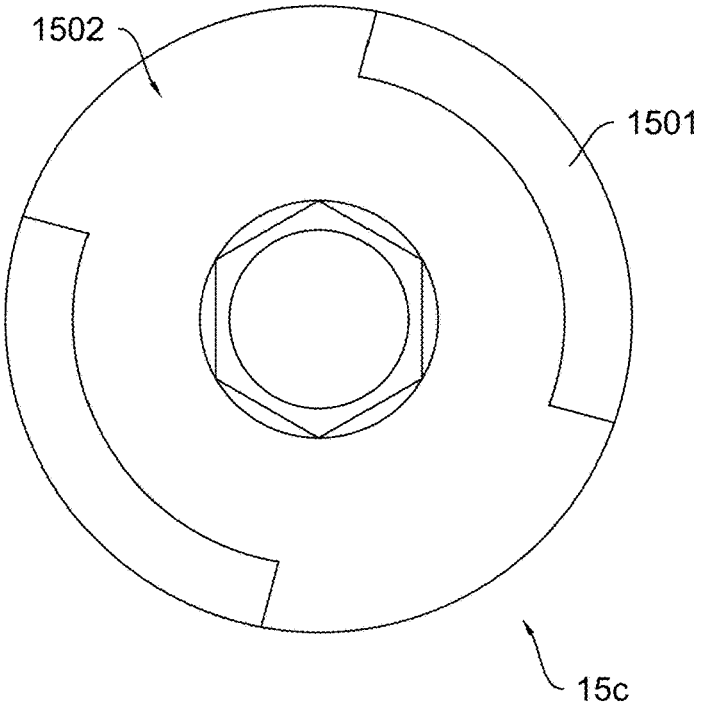
FIG. 7 is a structure diagram of a third lock disc in an embodiment of the present disclosure.
Figure 8:
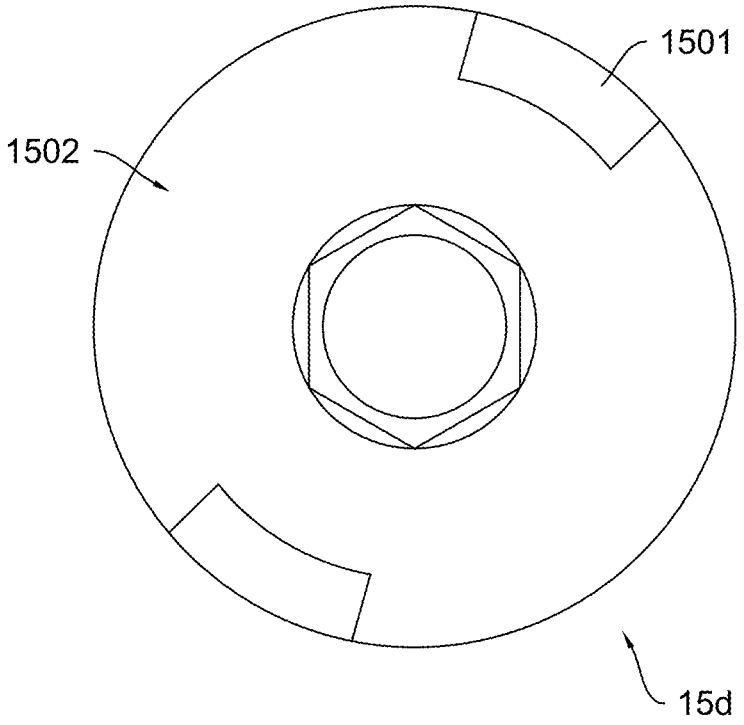
FIG. 8 is a structure diagram of a fourth lock disc in an embodiment of the present disclosure.
Figure 16:
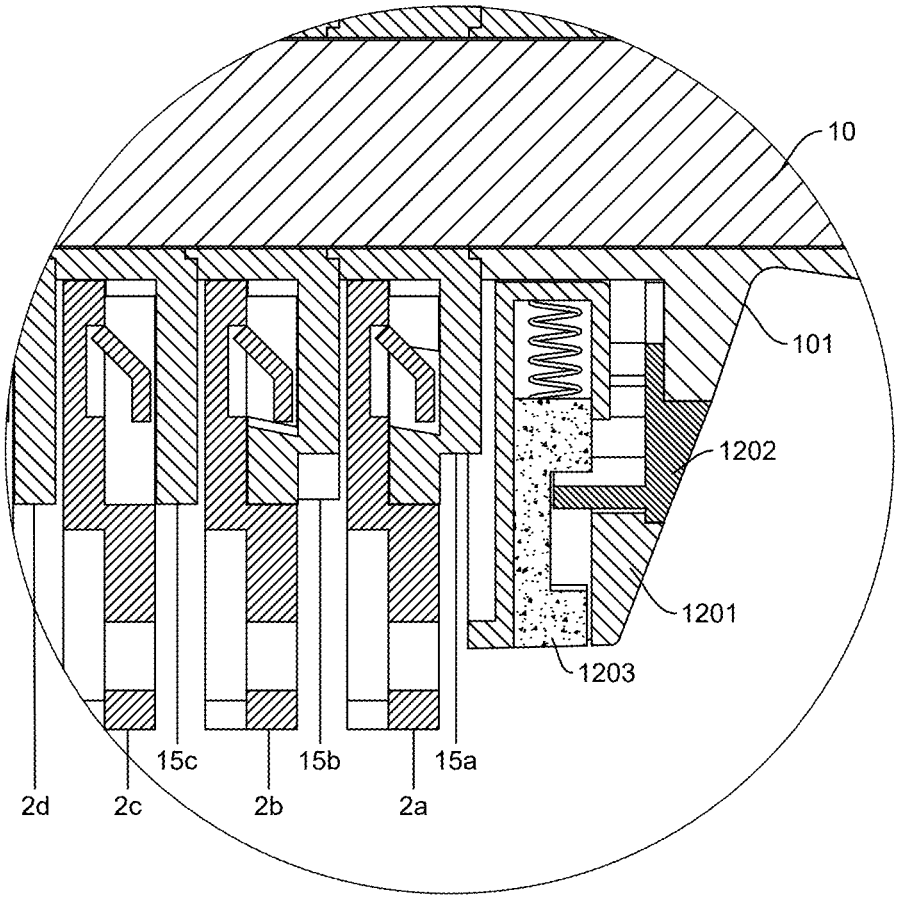
FIG. 16 is a partial enlarged view at part B in FIG. 2.

Further, the first lock disc 15*a* is shown in FIG. 4, the second lock disc 15*b* is shown in FIG. 6, the third lock disc 15*c* is shown in FIG. 7, the fourth lock disc 15*d* is shown in FIG. 8, the lock discs are located at initial positions in the hanging assemblies 11, and then clamping ports of all the lock discs 15 are located on lower sides of the lock discs 15. Each lock disc 15 corresponds to one dumbbell plate 2, the dumbbell plate 2 is inserted upwards into the respective hanging assembly 11, and the bottom of the insertion port 201 of the dumbbell plate 2 abuts against the stand column 1504 of the corresponding lock disc 15. The handle 10 is rotated to drive the lock discs to rotate clockwise, and all of the first lock disc 15*a*, the second lock disc 15*b*, the third lock disc 15*c* and the fourth lock disc 15*d* rotate clockwise and synchronously with the dumbbell rod 101. During the rotation process, a first dumbbell plate 2*a* is first locked by the first lock disc 15*a*, and a second dumbbell plate 2*b* is locked by the second lock disc 15*b* after continuous rotation. The state is as shown in FIG. 16, and the first dumbbell plate 2*a* and the second dumbbell plate 2*b* are interlocked with the corresponding first lock disc 15*a* and the corresponding second lock disc 15*b*. After continuous rotation, a third dumbbell plate 2*c* and a fourth dumbbell plate 2*d* are sequentially locked by the third lock disc 15*c* and the fourth lock disc 15*d*. In practice, the number of the hung dumbbell plates 2 can be selected as required.

As shown in FIGS. 2 and 3, in some embodiments, each of the hanging assemblies 11 further includes a first baffle 12, a second baffle 13, and a connecting plate 14 provided between the top of the first baffle 12 and the top of the second baffle, the plurality of lock discs 15 of the hanging assembly 11 are sequentially provided between the first baffle 12 and the second baffle 13, the first baffle 12 is provided with a second through hole 1201 allowing an end portion of the handle 10 to pass through, and the handle 10 can circumferentially rotate in the second through hole 1201. During assembly, a left hanging assembly 11*a* is taken as an example, as shown in FIG. 3, a left end of the handle 10 is sleeved with the first baffle 12, then the plurality of lock discs 15 are sequentially sleeved on the left side of the dumbbell rod 101, and finally, the second baffle 13 is provided at the end portion on the left side of the dumbbell rod 101. After assembly, the plurality of lock discs 15 can rotate synchronously with the handle 10.

After the dumbbell plates 2 are inserted in the hanging assemblies 11, the connecting plates 14 are clamped at inlets of the insertion ports 201 of the dumbbell plates 2. Two ends of each of the connecting plates 14 are fixedly connected to the respective first baffle 12 and the respective second baffle 13, and the connecting plate 14 is clamped in the insertion port 201 of the respective dumbbell plate 2, so that the first baffle 12 and the second baffle 13 are kept static relative to the dumbbell plate 2 in the circumferential direction by means of the connecting plate 14.

After the weight is adjusted, the handle 10 can still drive the lock discs 15 to rotate. When each lock disc 15 is rotated to a certain angle, the respective dumbbell plate 2 will be separated from the lock disc 15 to fall off from the respective hanging assembly 11. Thus, in the present application, each hanging assembly 11 is provided with a locking mechanism.

As shown in FIG. 3 and FIGS. 17-22, each locking mechanism includes a circular dividing disc 1202, the center of the dividing disc 1202 is provided with a third through hole 12024 allowing the end portion of the handle 10 to pass through, and the dividing disc 1202 can rotate synchronously with the handle 10. Each first baffle 12 is provided with a circular accommodating cavity for accommodating the respective dividing disc 1202 and a stopper 1203 for limiting rotation of the dividing disc 1202. The dividing disc 1202 is embedded in the accommodating cavity in a clearance fit manner and can rotate in the accommodating cavity in a circumferential direction. The side of the dividing disc 1202 close to the accommodating cavity is provided with a graduated ring 12021 extending outwards, and an inner wall of the graduated ring 12021 is provided with a plurality of uniformly distributed lock grooves 12022. The first baffle 12 is provided with a first sliding groove 1204 in a radial direction of the accommodating cavity, a first end of the first sliding groove 1204 is close to the center of the accommodating cavity, a second end thereof is an opening provided in a side wall of the first baffle 12, and the stopper 1203 is placed in the first sliding groove 1204 and can reciprocate in a lengthwise direction of the first sliding groove 1204. In order to maintain the outward movement trend of the stopper 1203, a first spring 1205 is provided in the first sliding groove 1204, one end of the first spring 1205 abuts against the first end of the first sliding groove 1204, and the other end abuts against a first end of the stopper 1203. The stopper 1203 is provided with a lock block 12031 fitted with the lock groove 12022, a second end of the stopper 1203 is provided with a pressing portion 12032, the pressing portion 12032 of the stopper 1203 is pressed to enable the stopper 1203 to move inwards, then the stopper 1203 is in an unlocked state, and the first spring 1205 is in a compressed state. The dividing disc 1202 is rotated, then the graduated ring 12021 can pass, in an unlimited manner, between the lock block 12031 and the pressing portion 12032 of the stopper 1203. When the dividing disc 1202 is rotated such that a certain lock groove 12022 is located in the same radial direction as the lock block 12031, the pressure of the pressing portion 12032 of the stopper 1203 is released, and the stopper 1203 moves outwards under the action of the elasticity of the first spring 1205. The lock block 12031 of the stopper 1203 is clamped in the lock groove 12022 of the graduated ring 12021, such that the dividing disc 1202 cannot rotate relative to the first baffle 12, and then the stopper 1203 is in a locked state.

The handle 10 and the dividing disc 1202 are in a synchronous state, when the locking mechanism is in the locked state, the handle 10 is fixed relative to the dividing disc 1202, the dividing disc 1202 is fixed relative to the first baffle 12, and the first baffle 12 is fixed relative to the respective dumbbell plate 2 on the hanging assembly 11 by means of the connecting plate 14. Thus, the handle 10 and the lock discs 15 cannot rotate relative to the dumbbell plates 2.

Figure 17:
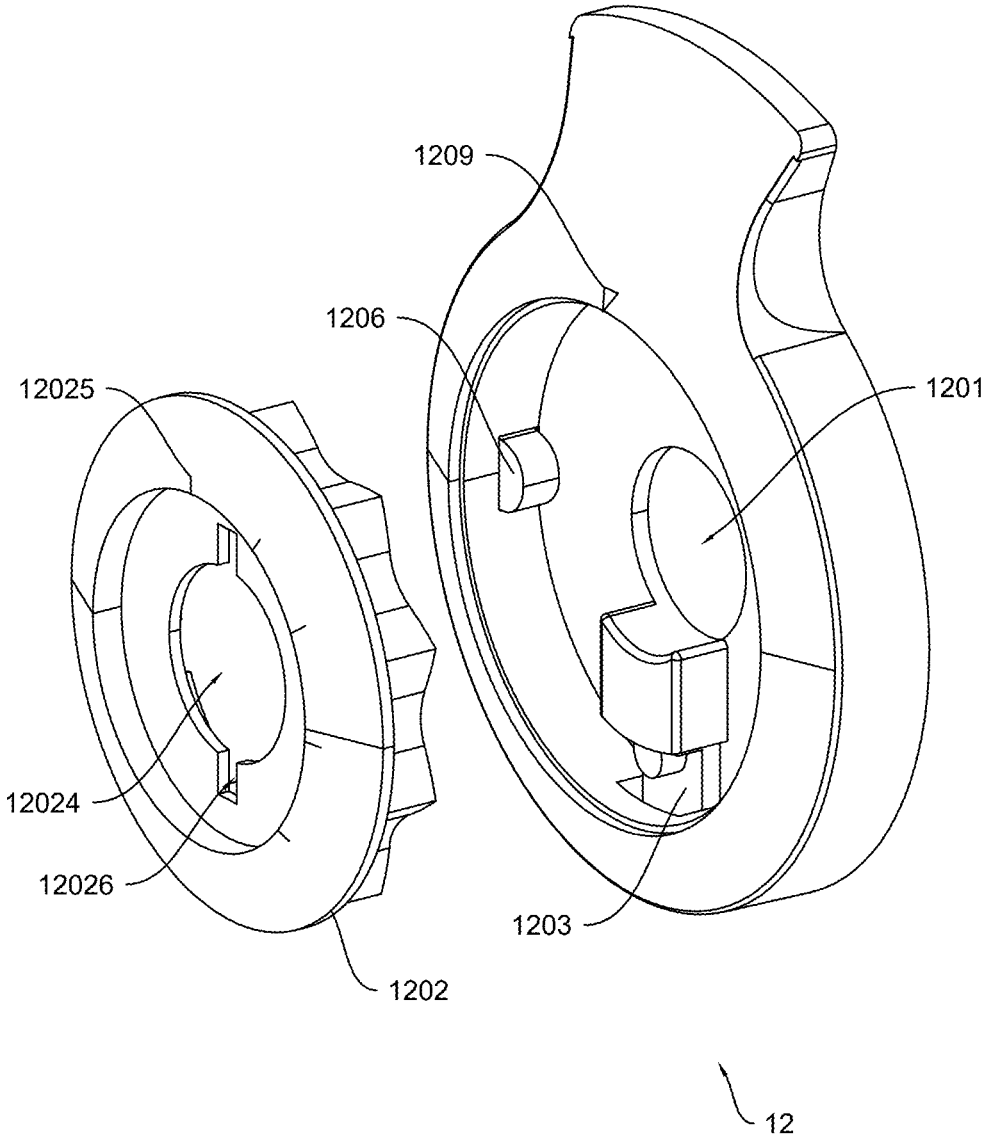
FIG. 17 is a structure diagram of a first baffle in an embodiment of the present disclosure.
Figure 18:
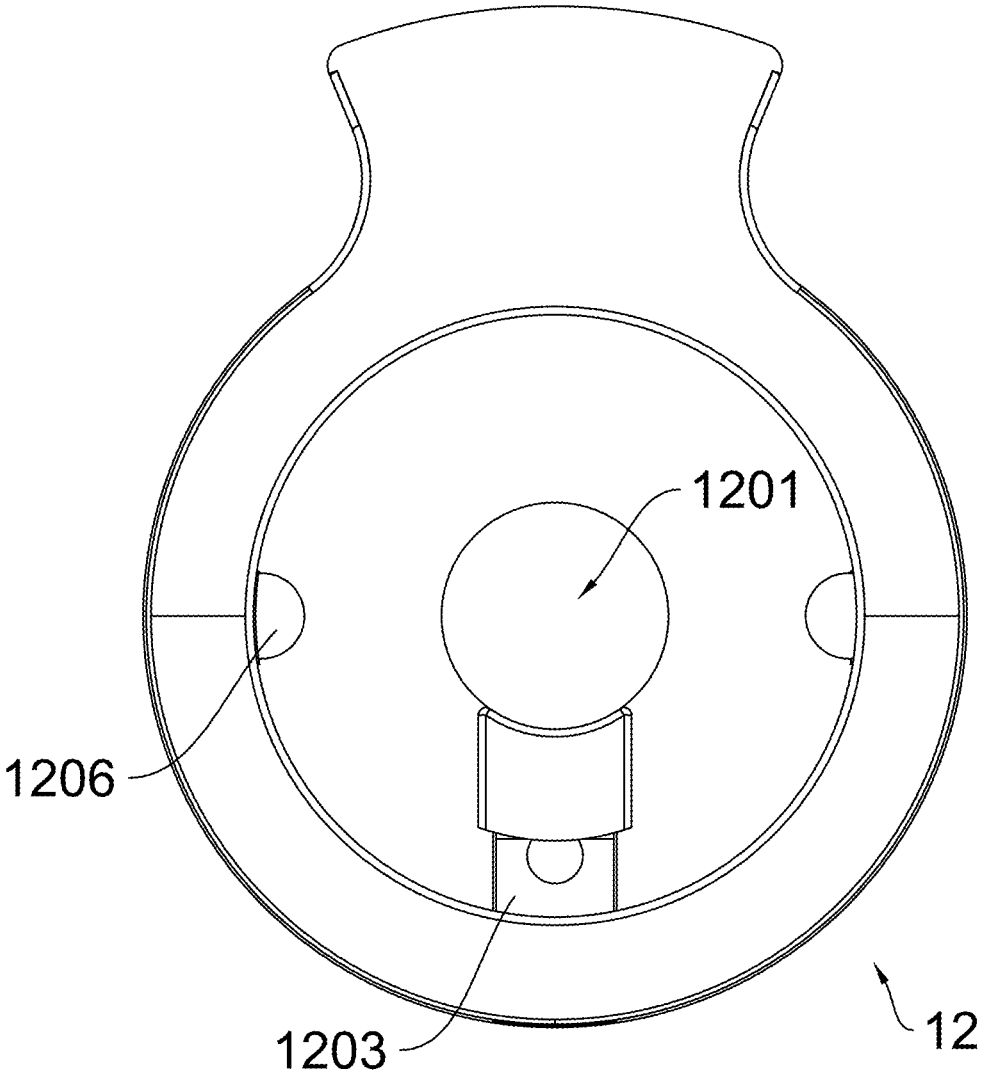
FIG. 18 is a second structure diagram of the first baffle in the embodiment of the present disclosure.
Figure 19:
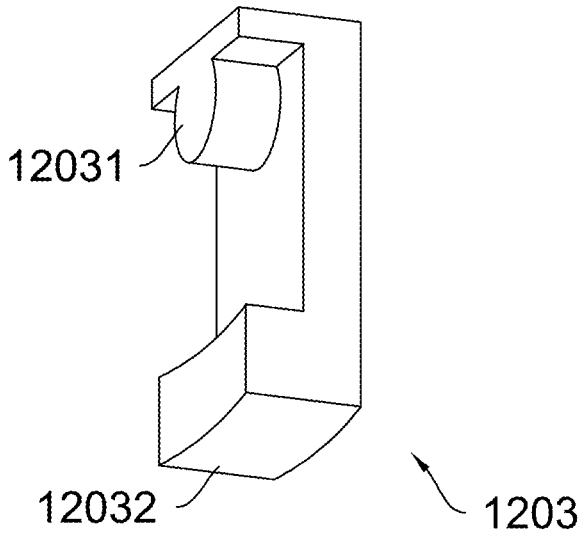
FIG. 19 is a structure diagram of a stopper in an embodiment of the present disclosure.
Figure 20:
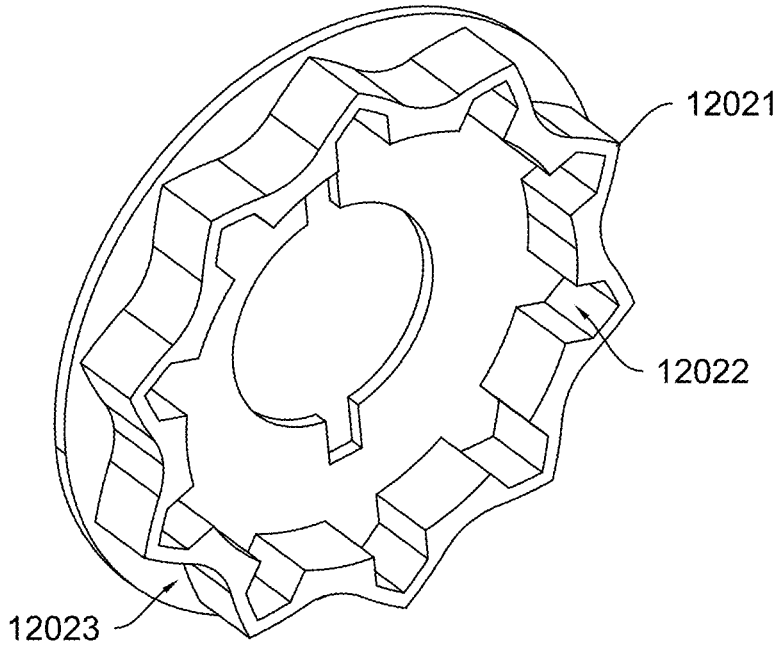
FIG. 20 is a structure diagram of a dividing disc in an embodiment of the present disclosure.
Figure 21:
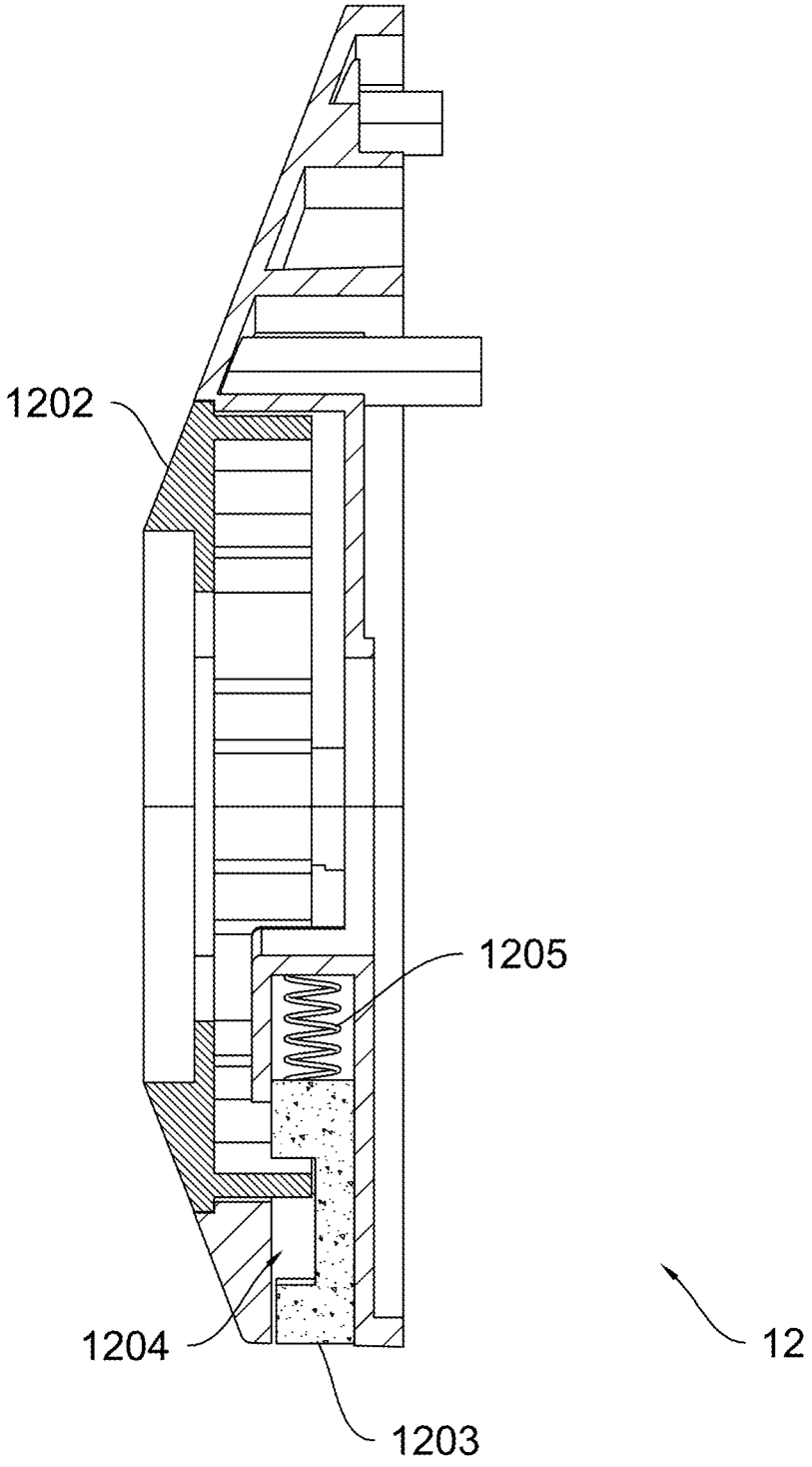
FIG. 21 is a section view of a first baffle at one viewing angle in an embodiment of the present disclosure.
Figure 22:
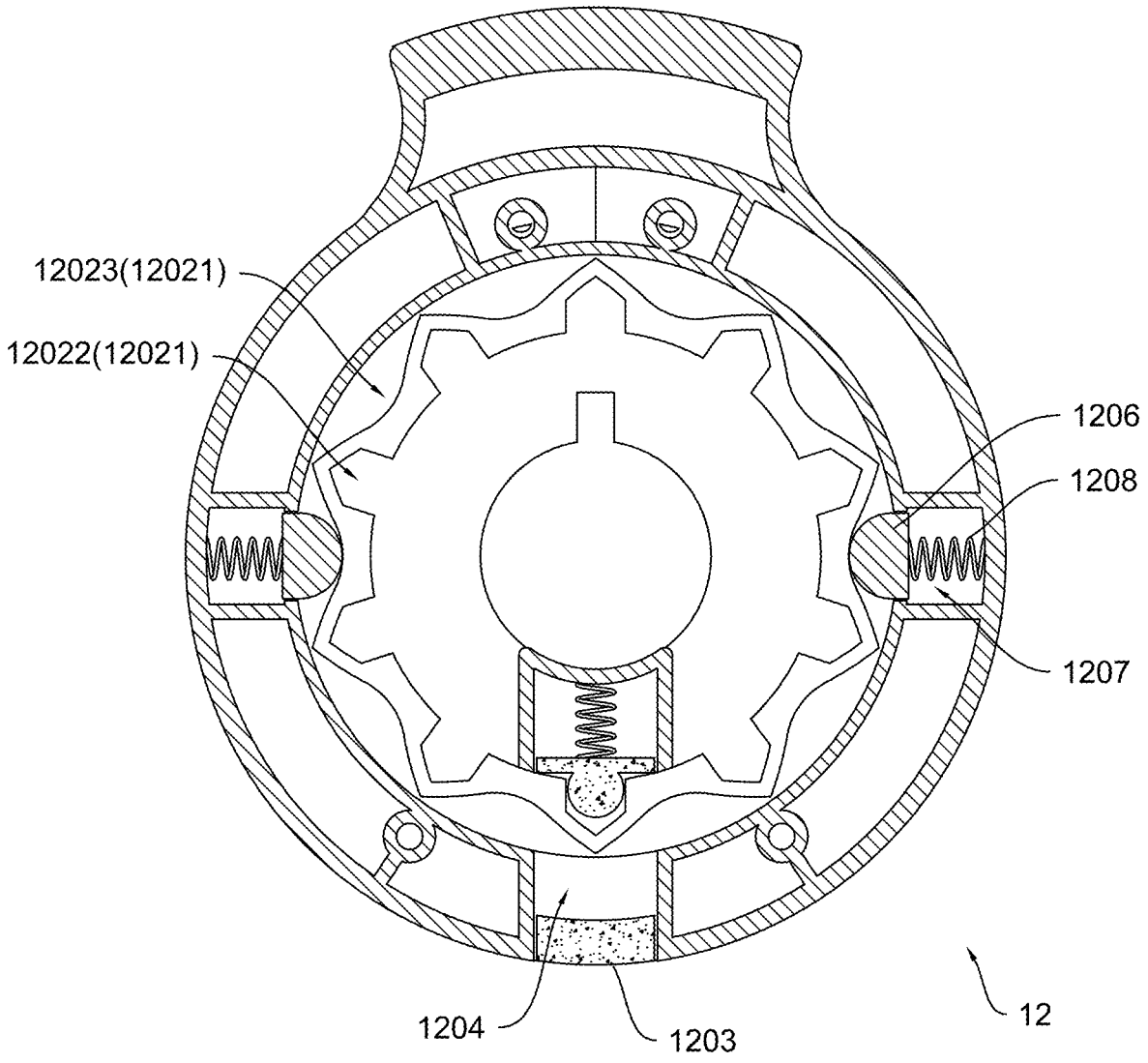
FIG. 22 is a section view of the first baffle at another viewing angle in the embodiment of the present disclosure.

As shown in FIGS. 17, 21 and 22, in order to prevent the lock block 12031 from staying between two lock grooves 12022 when each locking mechanism is switched from the unlocked state to the locked state, in some embodiments, the locking mechanism is provided with a guide structure. The guide structure includes a guide member 1206, and an end surface of a first end of the guide member 1206 is a smooth arc surface. At least one second sliding groove 1207 for accommodating the guide member 1206 is provided in a circumferential direction of a side wall of the accommodating cavity, and the guide member 1206 can reciprocate in the second sliding groove 1207 in the radial direction of the accommodating cavity. In order to maintain the inward movement trend of the guide member 1206, a second spring 1208 is provided in the second sliding groove 1207, one end of the second spring 1208 abuts against the end of the second sliding groove 1207 away from the accommodating cavity, and the other end abuts against a second end of the guide member 1206. The guide structure further includes a plurality of uniformly distributed guide grooves 12023 provided in an outer wall of the respective graduated ring 12021, the sections of the guide grooves 12023 are in smooth arc shapes, every two adjacent guide grooves 12023 are closely connected, and the number of the guide grooves 12023 is the same as that of the lock grooves 12022.

When the dividing disc 1202 rotates, the guide member 1206 is subjected to the action of the elasticity of the second spring 1208, and the first end of the guide member 1206 abuts against the outer wall of the graduated ring 12021 all the time. The adjacent guide grooves 12023 are closely connected, and the sections of the guide grooves 12023 are of arc-shaped structures. Thus, the guide member 1206 is only allowed to stay in one of the guide grooves 12023 and is guided by the arc surface to drive the dividing disc 1202 to rotate continuously until the first end of the guide member 1206 is located at the deepest position of the guide groove 12023, and this state can be defined as a stable state. At the same time, the lock block 12031 of the stopper 1203 is just located in the lock groove 12022. The guide grooves 12023 and the lock grooves 12022 are identical in number and are both uniformly distributed, so that the stopper 1203 and the guide member 1206 are maintained in the synchronous state all the time. That is, when the first end of the guide member 1206 is located at the deepest position of one of the guide grooves 12023, the lock block 12031 of the stopper 1203 is also located in one of the lock grooves 12022.

To facilitate reading weights at two ends of the dumbbell, the side of each of the dividing discs 1202 away from the respective accommodating cavity is provided with a graduated disc 12025, and the respective first baffle 12 is provided with a mark point 1209 matching the graduated disc 12025. During rotation of the dividing disc 1202, the weight value is read by means of a scale indicated by the mark point 1209.

In the above embodiments, the lock discs 15 and the dividing discs 1202 will rotate synchronously with the handle 10, and the specific implementation manner is as follows:

end portions of the handle 10 and end portions of lock columns 302 of the lock discs 15 are provided with first clamping ports, ends of the first through holes 1503 of the lock discs 15 away from the stand columns 1504 are provided with second clamping ports, and the first clamping ports are snap-fitted with the second clamping ports, thereby achieving synchronous rotation of the handle 10 and the lock discs 15. Specifically, the first clamping ports are polygonal columns 1507, the second clamping ports are polygonal grooves 1508 fitted with the first clamping ports, and the polygonal columns 1507 are fitted with the polygonal grooves 1508 to achieve synchronous rotation. In addition, in some embodiments, the first clamping ports are a plurality of protrusions distributed in the circumferential directions of the stand columns 1504, the second clamping ports are a plurality of clamping grooves fitted with the first clamping ports and distributed on inner walls of the first through holes 1503, and the plurality of protrusions are fitted with the plurality of clamping grooves to achieve synchronous rotation. Of course, the structures of the first clamping ports are interchangeable with the structures of the second clamping ports, which can still achieve the function of synchronous rotation.

Inner walls of the third through holes 12024 of the dividing discs 1202 are provided with a plurality of open grooves 12026 provided circumferentially, correspondingly, the handle 10 is provided with clamping protrusions 1011 fitted with openings, and synchronous rotation of the dividing discs 1202 and the handle 10 is achieved through fitting of the clamping protrusions 1011 and the open grooves 12026. Of course, when the structures of the clamping protrusions 1011 and the structures of the open grooves 12026 are interchanged on the handle 10 and the dividing discs 1202, synchronous rotation of the dividing discs 1202 and the handle 10 can also be achieved.

Figure 23:
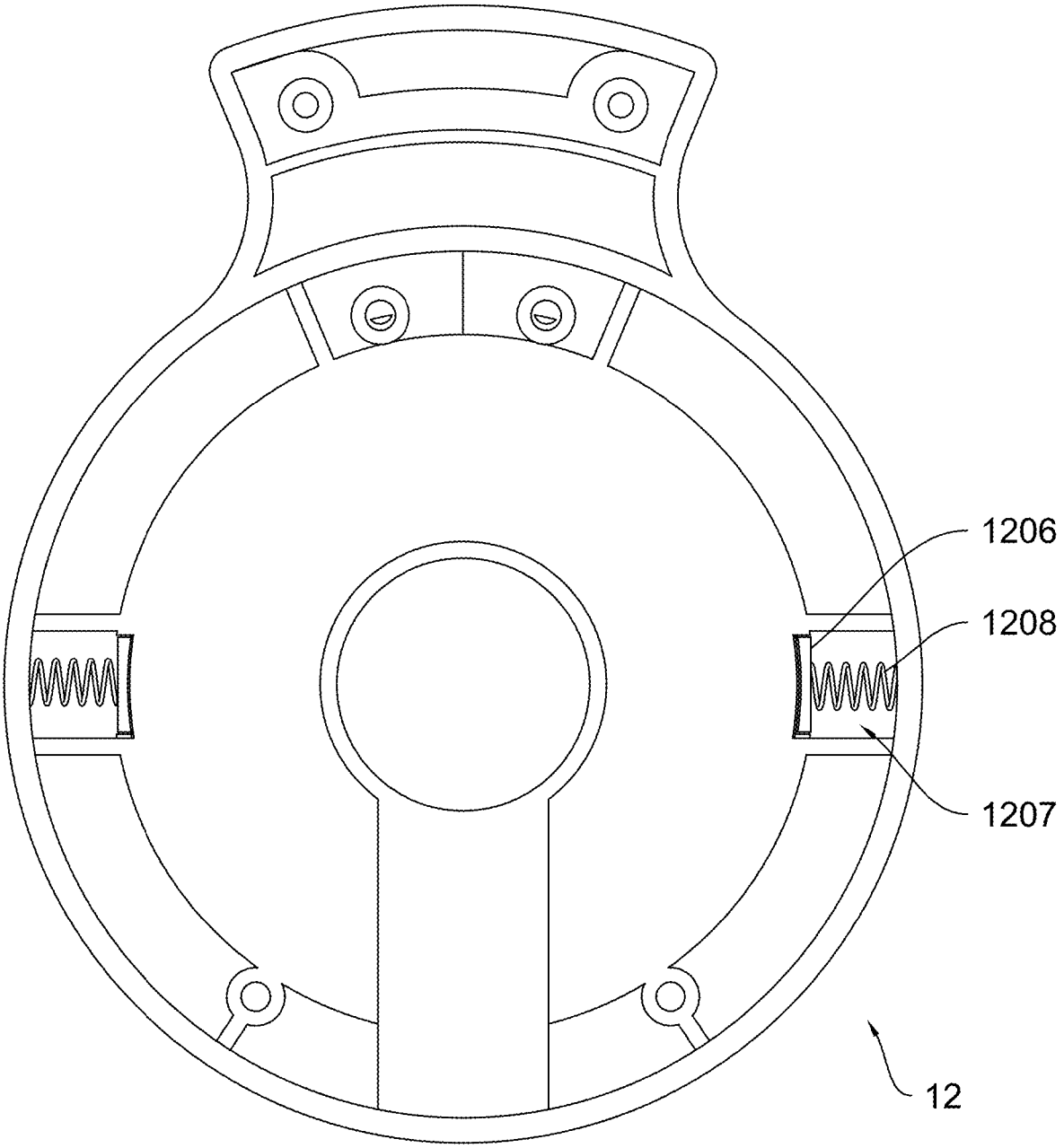
FIG. 23 is a structure diagram in an opposite direction of FIG. 18.
Figure 24:
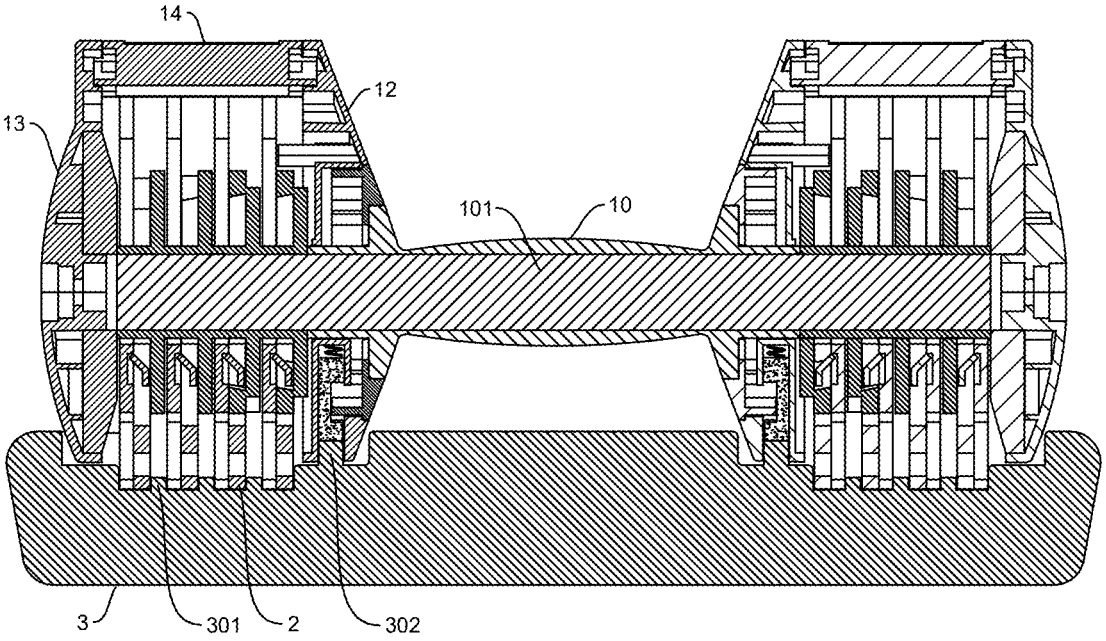
FIG. 24 is an overall structure section view of a dumbbell assembly in an embodiment of the present disclosure.

The present disclosure further discloses a dumbbell assembly, as shown in FIGS. 23 and 24, including the dumbbell and a tray for placing the dumbbell. The top of the tray is provided with a plurality of parallel insertion plates 301, the distance between the insertion plates 301 is equivalent to the thickness of the dumbbell plates 2, and the dumbbell plates 2 can be vertically placed between every two adjacent insertion plates 301.

In order to fit the locking mechanisms, the top of the tray is provided with the lock columns 302, and the second ends of the first sliding grooves 1204 of the locking mechanisms are provided at the bottoms of the first baffles 12. When the dumbbell is placed at the top of the tray, the lock columns 302 can extend into the first sliding grooves 1204 and apply pressure to the stoppers 1203, the stoppers 1203 move inwards, and thus the locking mechanisms are in the unlocked state. Then the dumbbell rod 101 can be rotated to drive the dividing discs 1202 and the lock discs 15, the dumbbell rod 101 is released after the appropriate weights are selected, and the dumbbell rod 101 is in a stable state at the guide structures. When the dumbbell is taken out of the tray, the lock columns 302 are separated from the first sliding grooves 1204, the stoppers 1203 move outwards under the action of the elasticity of the first springs 1205, the lock blocks 12031 of the stoppers 1203 enter the lock grooves 12022, and the locking mechanisms are switched to the locked state.

In some embodiments, the bottom of the tray is provided with a plurality of rubber anti-skid pads, which are configured to prevent the tray from scratching the ground when the tray is placed on the ground, and can also prevent the tray from sliding at will on the ground.

The above is merely illustrative of the preferred embodiments of the present disclosure and is not intended to limit the present disclosure, and various changes and modifications may be made on the present disclosure by those skilled in the art. Any modification, equivalent substitution, improvement, etc. made within the spirit and principles of the present disclosure should fall within the scope of protection of the present disclosure.

What is claimed is:

1. A dumbbell, comprising a dumbbell rod assembly, and a plurality of dumbbell plates, wherein the dumbbell rod assembly comprises a dumbbell rod; a top of each of the dumbbell plates is provided with a radially formed U-shaped insertion port, and a first surface of each dumbbell plate is provided with a second clamping portion protruding outwards and having a same radial direction as the insertion port;

a middle of the dumbbell rod is sleeved with a handle capable of rotating circumferentially around the dumbbell rod;

two sides of the dumbbell rod are provided with hanging assemblies respectively;

each of the hanging assemblies comprises a plurality of lock discs, and the plurality of lock discs are rotatably sleeved on the dumbbell rod in sequence and rotate synchronously with the handle;

a first surface of each of the lock discs is provided with at least one first clamping portion provided in a circumferential direction of an outer edge of the first surface and at least one clamping inlet configured to allow the second clamping portion of a respective one of the dumbbell plates to pass through, a center of each lock disc is provided with a stand column extending outwards along the first surface of the lock disc, and a center of the stand column is provided with a first through hole configured to allow the dumbbell rod to pass through;

the stand column of each of the lock discs is configured to be in clearance fit with the insertion port of the respective dumbbell plate, and is capable of reciprocating and circumferentially rotating in the insertion port in an open direction of the insertion port; and when each of the stand columns moves to a bottom of the respective insertion port, the respective lock disc is configured to rotate, and the second clamping portion of the respective dumbbell plate is capable of moving relatively between the stand column and the at least one first clamping portion of the respective lock disc and being clamped with the at least one first clamping portion;

wherein an end of each of the second clamping portions facing away from the respective insertion port is provided with a clamping groove with an opening formed in a circumferential direction of the respective dumbbell plate;

a radius of an arc-shaped bottom edge of an inner arc surface of each of the at least one first clamping portions is greater than that of an arc-shaped top edge; the inner arc surface is a tapered arc surface; when each of the second clamping portions is located between the stand column and the at least one first clamping portion of the respective lock disc, the arc-shaped top edge of the at least one first clamping portion extends into the respective clamping groove and the end of each second clamping portion facing away from the respective insertion port abuts the tapered arc surface, thereby limiting movement of the respective dumbbell plate in a radial direction and an axial direction of the corresponding lock disc.

2. The dumbbell according to claim 1, wherein each of the hanging assemblies further comprises a first baffle, a second baffle, and a connecting plate provided between a top of the first baffle and a top of the second baffle, and the respective plurality of lock discs are provided between the first baffle and the second baffle; and each of the first baffles is provided with a second through hole configured to allow an end portion of the handle to pass through, and each of the second baffles is connected to an end portion of the dumbbell rod.

3. The dumbbell according to claim 2, wherein each of the first baffles is provided with a locking mechanism, and the locking mechanism comprises a circular dividing disc and a stopper;

a center of each of the dividing discs is provided with a third through hole configured to allow the handle to pass through, each dividing disc is capable of rotating synchronously with the handle, a side of each dividing disc close to the respective first baffle is provided with a graduated ring extending outwards, and an inner wall of the graduated ring is provided with a plurality of uniformly distributed lock grooves;

each of the first baffles is provided with a first sliding groove in a radial direction thereof, a first end of the first sliding groove is close to the second through hole of the respective first baffle, the respective stopper is mounted in the first sliding groove and is capable of reciprocating in a lengthwise direction of the first sliding groove, the first sliding groove is internally provided with a first spring, one end of the first spring abuts against the first end of the first sliding groove, and a second end of the first spring abuts against a first end of the respective stopper;

a second end of each of the stoppers is provided with a pressing portion, and a lock block fitted with a corresponding one of the plurality of uniformly distributed lock grooves is provided between the first end of each of the stopper and the respective pressing portion: when each of the locking mechanisms is in an unlocked state, the respective dividing disc is configured to rotate, and the graduated ring of the respective dividing disc is capable of moving between the pressing portion and the lock block of the respective stopper; and when each of the locking mechanisms is in a locked state, the respective stopper is clamped with the respective dividing disc, and thus the respective dividing disc is incapable of rotating.

4. The dumbbell according to claim 3, wherein each of the locking mechanisms is further provided with a guide structure;

each of the guide structures comprises a guide member, at least one second sliding groove for accommodating the guide member is provided in a circumferential direction of the respective first baffle, the at least one second sliding groove is formed in a radial direction of the respective first baffle, and the guide member is capable of reciprocating in a lengthwise direction of the respective second sliding groove; each of the second sliding grooves is internally provided with a second spring, one end of the second spring abuts against an end of the respective second sliding groove away from the respective second through hole, a second end of the second spring abuts against a second end of the respective guide member, and a first end of the respective guide member faces the center of the second through hole;

each of the guide structures further comprises a plurality of uniformly distributed guide grooves provided in an outer wall of the respective graduated ring, sections of the guide grooves are in smooth arc shapes, and every two adjacent guide grooves are closely connected; the number of the guide grooves is the same as that of the lock grooves; and when the first end of each of the guide members is located at a deepest position of one of the respective guide grooves, the lock block of the respective stopper is located in one of the respective lock grooves at the same time.

5. The dumbbell according to claim 3, wherein a side of each of the dividing discs facing away from the respective graduated ring is provided with a graduated disc, and the respective first baffle is provided with a mark point matching the graduated disc.

6. A dumbbell assembly, comprising the dumbbell according to claim 3, and a tray for placing the dumbbell, wherein a top of the tray is provided with a plurality of parallel insertion plates, and the dumbbell plates are capable of being vertically placed between every two adjacent insertion plates;

the top of the tray is provided with lock columns, and when the dumbbell is placed at the top of the tray, the lock columns are capable of extending into the first sliding grooves and driving the stoppers to move inwards, enabling the locking mechanisms to be in the unlocked state; and when the dumbbell is taken out of the tray, the lock columns are separated from the first sliding grooves, the stoppers move outwards under the action of the elasticity of the first springs, the lock blocks of the stoppers enter the lock grooves, and the locking mechanisms are switched to the locked state.

7. The dumbbell according to claim 1, wherein each of the lock discs is provided with at least two first clamping portions having a same radian value; or a radian of the first clamping portions of the plurality of lock discs in each of the hanging assemblies at least has two radian values, and the radian values are gradually reduced or increased.

8. The dumbbell according to claim 1, wherein one surface of each of the dumbbell plates is provided with a weight stack, the weight stack is provided with a U-shaped accommodating groove having the same open direction as the respective insertion port, the accommodating groove is capable of receiving any one of the plurality of lock discs, and any one of the plurality of lock discs is capable of reciprocating and circumferentially rotating in the accommodating groove in the open direction thereof.

* * * * *